United States Patent [19]

Skillicorn

[11] Patent Number: 4,646,338

[45] Date of Patent: Feb. 24, 1987

[54] MODULAR PORTABLE X-RAY SOURCE WITH INTEGRAL GENERATOR

[75] Inventor: Brian Skillicorn, Sunnyvale, Calif.

[73] Assignee: Kevex Corporation, Foster City, Calif.

[21] Appl. No.: 519,402

[22] Filed: Aug. 1, 1983

[51] Int. Cl.[4] ..... H05G 1/34; H05G 1/32; H05G 1/10; H05G 1/02

[52] U.S. Cl. ..... 378/110; 378/112; 378/102; 378/198

[58] Field of Search ..... 378/102–103, 378/104, 110, 112, 193, 200, 198

[56] References Cited

U.S. PATENT DOCUMENTS

| | | | |
|---|---|---|---|
| 1,974,328 | 9/1934 | Bouwers | 378/103 |
| 2,659,015 | 11/1953 | Lee | 378/111 |
| 2,969,464 | 1/1961 | Chisholm et al. | 378/102 |
| 3,125,679 | 3/1964 | Ohde et al. | 378/103 |
| 3,130,312 | 4/1964 | Craig | 378/96 |
| 3,256,439 | 6/1966 | Dyke et al. | 378/102 |
| 3,663,942 | 5/1972 | Jakobsen | 363/57 |
| 3,812,366 | 5/1974 | Gralenski | 250/421 |
| 3,828,194 | 8/1974 | Grasser | 378/114 |
| 3,878,394 | 4/1975 | Golden | 378/102 |
| 4,117,334 | 9/1978 | Strauts | 378/102 |
| 4,170,735 | 10/1979 | Codina et al. | 378/110 |
| 4,370,752 | 1/1983 | Furuichi et al. | 378/110 |
| 4,418,421 | 11/1983 | Kitadate et al. | 378/199 |
| 4,510,476 | 4/1985 | Clatterbuck et al. | 336/84 C |
| 4,517,472 | 5/1985 | Ruitberg et al. | 307/82 |

OTHER PUBLICATIONS

One sheet brochure entitled "Kevex Announces a New Product Line . . . Portable X-Ray Sources", published 8/83.

Kevex brochure "PXS$^{tm}$ Portable X-Ray Sources", May, 1984 Encyclopedia of Physics, 2nd Ed., Van Nostrand Reinhold Co., NY, pp. 9, 10, 636.

NASA Tech Briefs, Spring 1984, vol. 8, No. 3, GSC-12818, "Battery Operated High-Voltage Power Supply".

*Primary Examiner*—Craig E. Church
*Assistant Examiner*—Charles Wieland
*Attorney, Agent, or Firm*—David B. Harrison

[57] ABSTRACT

A modular portable X-ray source with integral generator system for generating continuous X-rays of regulated intensity and energy level over a range from zero to maximum and includes a unitary housing containing an X-ray tube, a direct current high voltage power supply for generating a directly controllable, regulated high voltage, a regulated filament supply for generating a directly controllable, regulated beam current, both supplies being directly connected to the X-ray tube without cabling, both supplies being controlled by feedback control signals directly from the X-ray tube, and both being operated directly from a low voltage high current supply, such as a storage battery.

23 Claims, 9 Drawing Figures

202
200
38
R32 1K 1%
C21 1.0
C22 10
D8 IN4148
R22 10K
R23 75K 1%
R24 10K
D12 IN4148
-5V
B
D7 IN4148
D11 IN4148
A
+5V
U5
R21 10K
R31 10K
204
206
R20 10K 0.1%
R30 10K 0.1%
R19 10K 0.1%
R18 10K 0.1%
208
40
226
R29 200K 1%
C20 1.0
R57 120K
R16 560K
C16 0.1
R28 200K 1%
46
D10 IN4148
212
R27 4.7K
210
R40 10K
U7
44
C30 1.0
R56 10K
H.V. MDN
9
R39 10K
42
C29 1.0
R55 10K
mA MDN
8
R53 3K
R54 5K
MDN GND
10
R38 10K
R52 4.7K
OVERCURRENT SET
R58 470
R51 10K
D18 IN4148
D17 IN4148
R50 22.1K
C27 1.0
PROG GND
7
R37 6.8K
C25 1.0
R36 100K
R49 22.1K
228
mA PROG
6
TO 56
54
D16 IN4148
R35 10K
H.V. PROG
5
TO 48
230

MODULAR PORTABLE X-RAY SOURCE WITH INTEGRAL GENERATOR

The present invention relates to x-ray generation equipment. More particularly, the present invention relates to a modular portable x-ray source system including an integral generator.

X-ray generators are well known. X-radiation is generated by impingement of a highly accelerated electron beam upon matter, such as an anode of an x-ray tube. The principles of x-radiation generation are well documented elsewhere and will not be repeated here.

Previous workers in the art have proposed various types of portable x-ray generators. For example, the Strauts U.S. Pat. No. 4,117,334 described a portable x-ray generating unit with a self-contained high voltage supply in a switching arrangement. The power supply provided pulsating direct current to the x-ray tube by virtue of two step-up transformers with reversible primary relationships. By switching the primaries to the reversed phase arrangement, the alternating voltages across the secondary windings became additive, thereby enabling selection said to be between 150 and 300 kV. The Strauts device does not appear to be modular or very well regulated, and one would expect that the x-ray fluxes generated by the Strauts device varied widely with variations in line voltage, etc.

The Jakobsen U.S. Pat. No. 3,663,942 described an arc-over protection scheme for a switching power supply for an x-ray tube. The Jakobsen approach applied alternating current to the x-ray tube and did not provide for a highly regulated output flux independent of supply variations. In addition, Jakobsen did not teach a small, completely self contained, modular x-ray source and generator.

The Chisholm et al. U.S. Pat. No. 2,969,464 described an impulse powered portable x-ray generator which employed a hand operated generator to generate a momentary high voltage for application to an x-ray tube. No voltage regulation was taught by this patent.

The Craig U.S. Pat. No. 3,130,312 described an x-ray apparatus which included a timer system to generate x-radiation pulses having a duration shorter than a half cycle of the line voltage power supply (60 Hz). The short duration radiation peaks were said to be helpful in improving resolution of x-ray photographs, although clearly the flux put out by the Craig tube varied widely with the line voltage, etc. Also, Craig did not achieve a truly portable, modular system.

One drawback of the prior art x-ray generation systems was that they lacked true modularity and compactness.

Another drawback was that such systems were not capable of putting out highly controllable x-ray fluxes independent of supply voltage variations.

SUMMARY OF THE INVENTION WITH OBJECTS

A general object of the present invention is to provide a truly portable, modular x-ray source having an integral generator which is capable of putting out high intensity x-radiation having controllable energy and intensity.

Another object of the present invention is to provide a compact x-ray source system which is advantageously useful for a wide variety of applications such as x-ray fluorescence elemental analysis, thickness gauging, radiography and imaging systems, particle size characterization, industrial on-line process control, stress measurements, diffraction, and the like.

A further object of the present invention is to provide a portable, hand held (except during use) x-ray generator system which may operate from available low DC input voltages, such as automobile batteries.

Another object of the present invention is to provide an x-ray tube, high voltage generator and control electronics in one single compact unit occupying less than one half cubic foot of space and weighing under ten pounds.

A further object of the present invention is to provide a highly reliable x-ray source and generator system which avoids any high voltage cable between the x-ray tube and the high voltage power supply.

One more object of the present invention is to provide a modular portable x-ray source and generator system which may advantageously utilize a variety of available, interchangeable x-ray tubes having both reflective solid targets and transmission targets of various materials, and wherein the targets are grounded or at high positive potential with grid control circuitry for pulse tube operation.

A further object of the present invention is to provide a modular portable x-ray system which is self shielding and which may be effectively cooled by convection, conduction or cooling liquid.

One more object of the present invention is to provide a modular portable x-ray system which includes a duty cycle modulated switching high voltage power supply having a control loop servo for self regulation and having provision for external programming and control of high voltage and x-ray intensity.

Yet another object of the present invention is to provide a modular portable x-ray system which includes a duty cycle modulated switching filament power supply having a control loop servo for self regulation and having provision for external programming and control of x-ray tube filament current and x-ray beam intensity.

One more object of the present invention is to provide a modular portable x-ray system which provides the capability of generating highly regulated and controlled x-ray fluxes at excitation levels of fifty watts, or more.

Still another object of the present invention is to provide a small modular x-ray generation system which includes a unique monolithic block structure containing high voltage multiplier elements of the high voltage power supply and also for mounting the x-ray tube in a cooling liquid-filling well formed therein for the tube, and further including a unique cooling liquid expansion and contraction arrangement to prevent escape of the cooling liquid.

The modular portable x-ray source with integral generator system of the present invention includes an x-ray tube having a cathode and an anode emitting x-rays as a consequence of bombardment of an accelerated electron beam emitted by the cathode. The system includes a direct current high voltage power supply for generating a directly controllable, regulated high voltage from a low supply voltage externally supplied. The high voltage is connected across the cathode and anode of the x-ray tube to generate x-rays of controllable energy level. A filament power supply generates and supplies regulated filament current to operate the cathode of the x-ray tube.

These and other objects, advantages and features of the present invention will be apparent to those skilled in the art from a consideration of the following detailed description of preferred embodiments, presented in conjunction with the accompanying drawings.

DETAILED DESCRIPTION OF PREFERRED EMBODIMENTS

Overview of System 10

Figure 1:
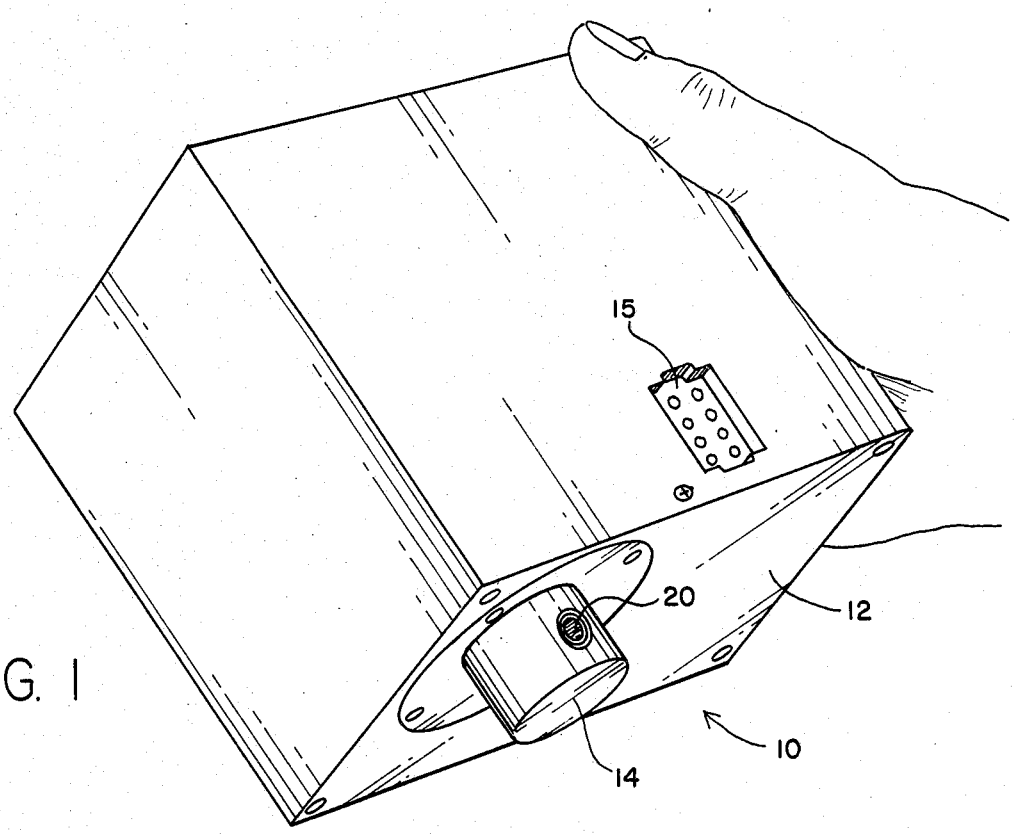
FIG. 1 is a perspective view of a modular portable x-ray source with integral generator system in accordance with the principles of the present invention.

A modular portable x-ray source with integral generator system 10 which incorporates the principles of the present invention is depicted in structural overview in FIG. 1. Therein, the system 10 is contained in a housing 12 which typically measures 4.2" in width, 6.2" in length, and 5.2" in height. The unit as shown in FIG. 1 weighs approximately 7½ pounds.

The housing 12 contains a demountable x-ray tube 14 (shown to be of the reflective type) capable of dissipating up to 50 watts, and a power supply jack 15 for connection to a low voltage direct current power source (e.g. 12 volts at 7 amperes, or 28 volts at 3 amperes). The hand-held system 10 is shown disconnected in FIG. 1 from its power source for obvious reasons of safety to the person holding it.

Figure 2:
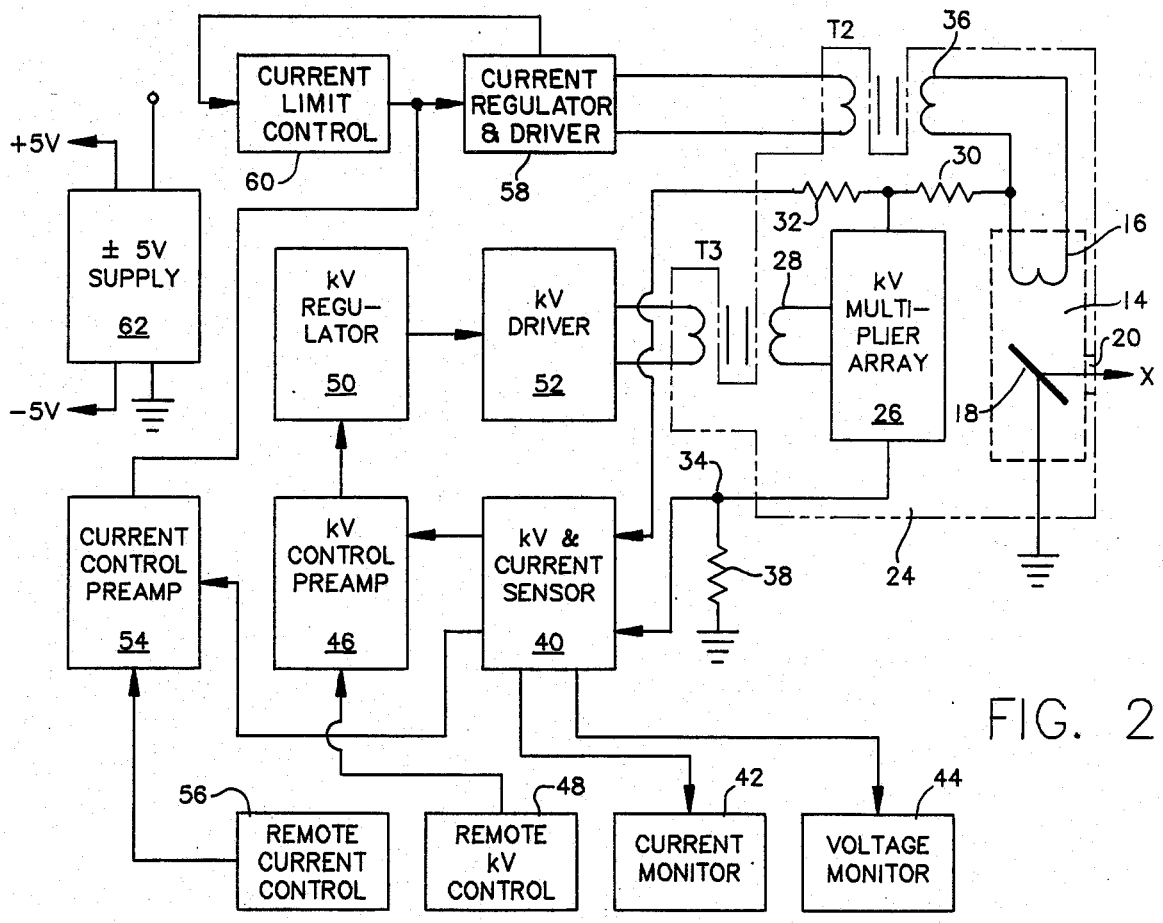
FIG. 2 is a functional block diagram of the system depicted in FIG. 1.

The separate functional elements of the system are set forth in the overall block diagram of FIG. 2. Therein, the tube 14 includes a direct cathode 16 and a grounded anode 18 of the reflective type. X-rays (shown by arrows x) radiate from the high vacuum tube through a thin beryllium window 20.

The tube 14 is contained in a sealed well 22 within a vacuum molded high voltage circuitry housing block 24 formed of curable plastic resin material, or other suitable insulating material, in which all air pockets and other voids have been removed to prevent corona and consequent damage during high voltage operations.

The high voltage block 24 includes a Cockcroft-Walton type, (named after the physicists who first demonstrated nuclear fusion) voltage multiplier diode and capacitor array 26 which multiplies 3.5 kV from an imbedded secondary winding 28 of a switching supply transformer T3 into a high voltage supply of up to 50 kV at up to 1 milliampere in accordance with commanded high voltage and current control values provided to the system 10 manually or under computer control.

The high voltage block 24 further contains a 24 kilohm current limiting resistor 30, a voltage measurement resistor chain 32 and a power supply return connection 34. An imbedded secondary winding 36 for a filament transformer T2 is also integrally formed in the block 24.

High voltage passing through the voltage measurement resistor chain 32, and voltage proportional to beam current developed across a current measurement resistor 38 shunting the return connection 34 to ground are both supplied to a high voltage and current sensing and separating circuit 40. The sensing circuit 40 is connected to a current monitor circuit 42, which may be an external metering circuit, or an analog to digital converter for converting measured beam current to digital values readible directly by a computer, and the circuit 40 is likewise connected to a high voltage monitor circuit 44, also capable of being an external metering circuit or analog to digital converter.

A voltage proportional to monitored high voltage is supplied by the circuit 40 to a high voltage control preamplifier circuit 46 which is under the control of a remote high voltage control circuit 48. The control circuit 48 may be a potentiometer within the housing 12, or it may be a digital to analog converter to enable direct computer control of the high voltage.

The high voltage control preamplifier circuit 46 supplies a control voltage to a high voltage regulator circuit 50 which is preferably implemented as a pulse width modulator. The output thereof is a pair of opposed phase pulse trains whose duty cycles are proportional to the desired high voltage. These pulse trains control a switching power supply driver circuit 52. The circuit 52 is connected to drive the high voltage switching transformer T3 at a switching frequency of approximately 25 kHz.

A voltage proportional to monitored beam current of the x-ray tube 14 is delivered by the current sense circuit 40 to a current control preamplifier circuit 54 which is under the control of a remote current control circuit 56 which may also be a potentiometer within the housing 12, or a digital to analog converter to enable direct computer control of beam current.

The current control preamplifier circuit 54 supplies a voltage proportional to desired beam current to a current regulator and driver circuit 58, preferably implemented as a pulse width modulated switching power supply. The current driver circuit 58 is connected to drive the primary winding of the filament transformer T2. A current limit control circuit 60 monitors the current put out by the driver circuit 58 in relation to a preset maximum current and acts automatically to limit beam current in the event of arc over or other avalanche current conditions which would otherwise burn out the tube 14.

A plus and minus five volt power supply 62 is provided to supply reference voltages to the operational amplifiers which implement many aspects of the control circuitry of the system 10. The supply 62 operates off of the primary low direct current supply and is preferably implemented as an oscillator and full wave rectifier.

X-ray Tubes 14

Figure 3:
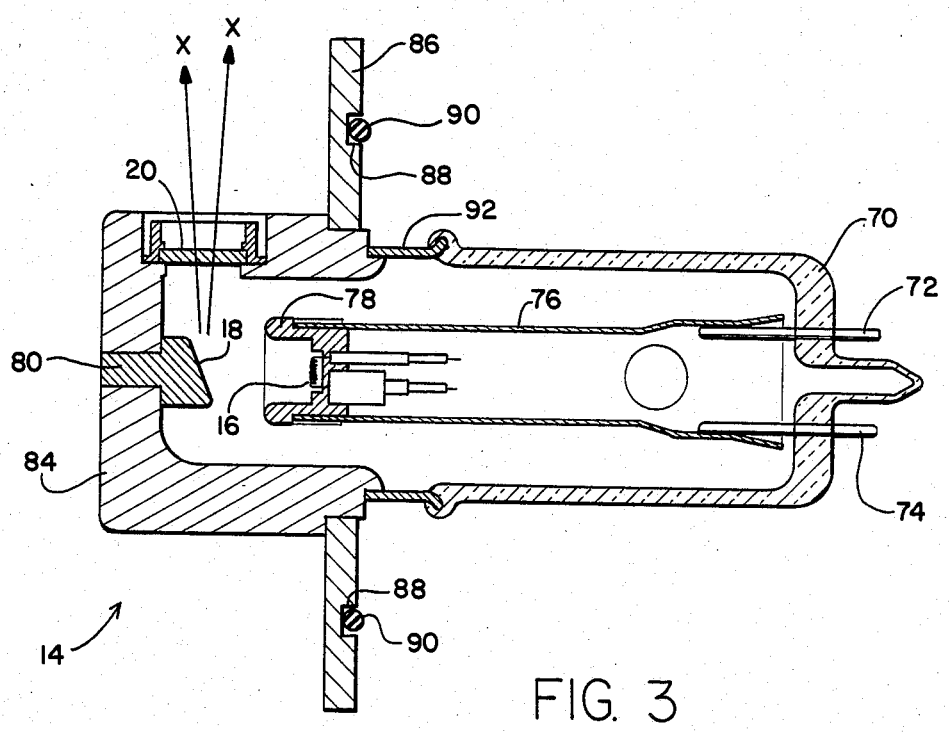
FIG. 3 is a view in side elevation and section of a reflective target x-ray tube for use in the system depicted in FIG. 1.

FIG. 3 depicts internal structural details of the x-ray tube 14 shown installed in the housing 12 in FIG. 1. In FIG. 3, the tube 14 includes a glass envelope 70 which supports support and connection pins 72 and 74. The pins 72 and 74 are internally connected to one end of a cylindrical member 76 which supports a focusing cup 78 at its other end. The tube filament 16 is seated in a recess of the focusing cup 78, and the cup 78 causes the electrons to become sharply focused and strike the target 18 at a concentration point.

The target 18 is made of a solid metal element block 80 which is secured to a thick copper cap 84. The cap 84 includes the beryllium x-ray window 20, and it includes a circular mounting flange 86 which mounts the tube 14 to the housing 12 by suitable screws. An annular groove 88 in the mounting flange 86, and an O-ring seal 90 is seated therein and facilitates a positive seal between the tube 14 and the housing 12. A thin cylindrical member 92 contiguously bonded to the copper cap is embedded in sealing relationship with the cylindrical glass envelope 70 to enable an airtight and highly evacuated interior for the tube 14.

It is important to note in passing that the filament 16 and x-ray target 18 are placed well away from the glass envelope 70, so that electrostatic charges therein causes by x-rays striking the glass will not cause the electron beam to become deflected and out of focus.

Figure 4:
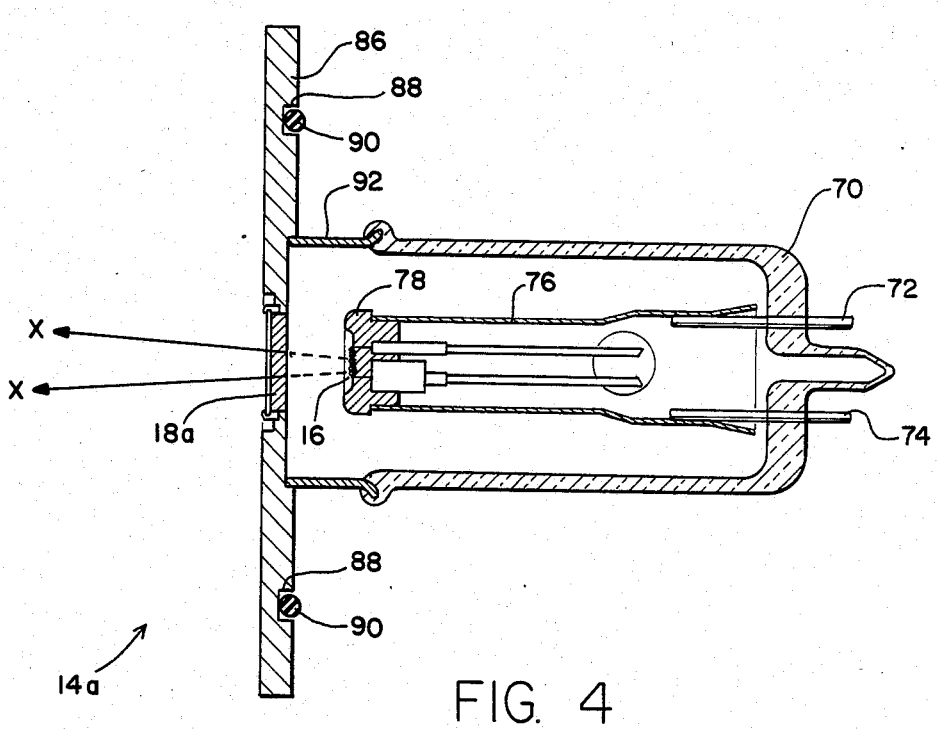
FIG. 4 is a view side elevation and section of a transmissive target x-ray tube for use in the system depicted in FIG. 1.

A transmission x-ray tube 14*a*, having a thin metal transmission target 18*a* is depicted in FIG. 4. The elements of the FIG. 4 transmission tube which are similar to the reflective target tube of FIG. 3 bear the same reference numerals and will not be separately described.

Housing 12

Figure 5:
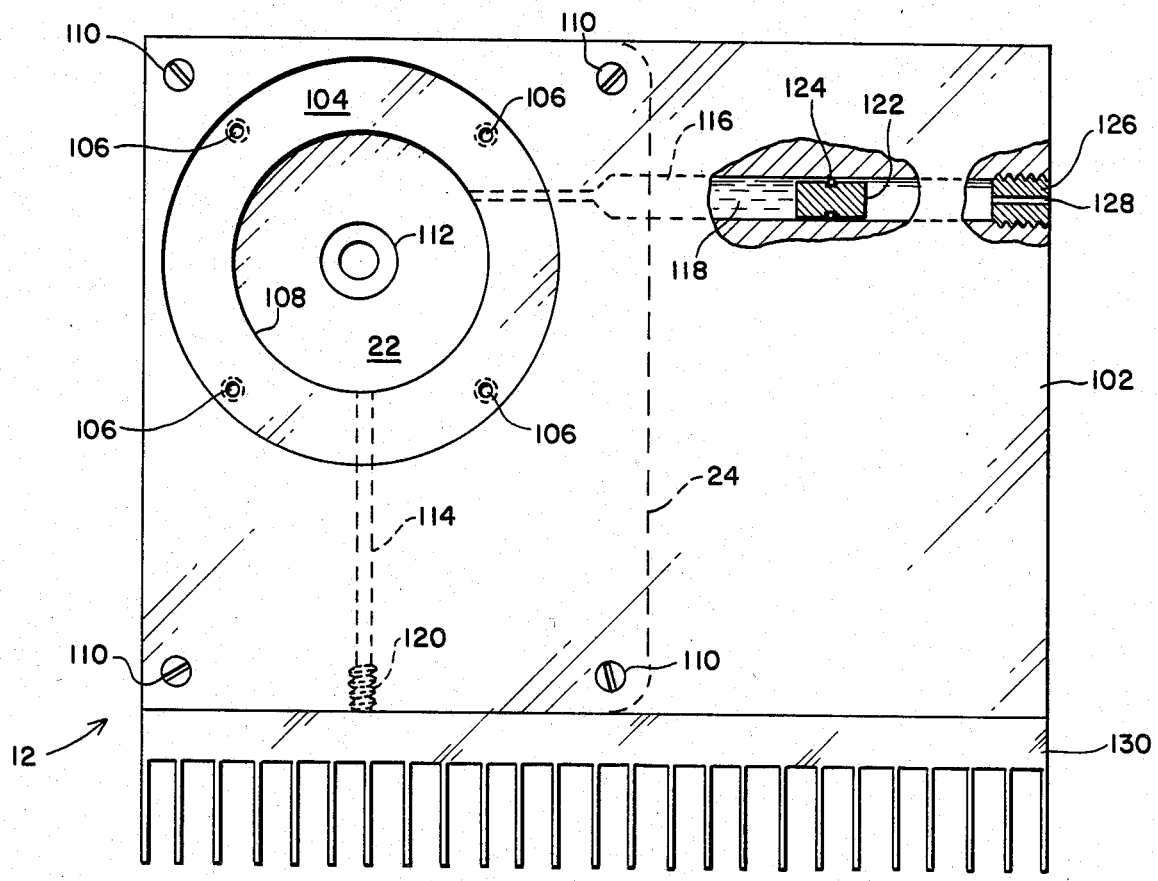
FIG. 5 is a top plan view of the system depicted in FIG. 1 with portions thereof broken away in aid of clarity of illustration.

As depicted in FIG. 5, the housing 12 includes a thick aluminum top plate 102 which defines an annular recess 104 and four threaded apertures 106 for mounting the tube 14 so that its mounting flange 86 is flush with the outer surface of the plate 102. A central opening 108 within the recess 104 defines the well 22 for the tube. The high voltage block 24 is secured to the plate 102 by four screws 110. The well 22 extends for a substantial distance into the high voltage block, as shown by dashed lines in FIG. 6. An annular connection socket 112 in the base of the well provides for electrical connections to the filament 16 of the x-ray tube 14.

Two separate orifices 114 and 116 are provided in the metal plate 102. The first orifice 114 enables the well 22 to be filled with an insulating and air-displacing liquid 118, such as mineral oil commonly used in transformers. It is important that all of the space of the well 22 be filled with oil to prevent corona, flash-over and possible consequent damage to the block 24. The filling orifice 114 is closed by a screw plug 120.

The other orifice 116 is bored to approximately one quarter inch, inside diameter, for a distance of approximately three inches. A small piston 122 having an annular groove and an O-ring 124 therein is seated in the orifice 116 and freely moves back and forth therein in sealing sliding engagement, so that the cooling liquid 118 is free to expand and contract as the tube 14 and block 24 heat up during use and cool off thereafter, without expulsion or loss thereof on account of the expansion. A threaded plug 126 having a vent 128 to the atmosphere locks the piston 122 in the orifice 116.

A finned heat sink 130 is mounted to the plate 102 and abuts the block 24 to conduct heat away therefrom by convection currents. Cooling of the system 10 may be by convection, conduction or liquid such as water.

Figure 6:
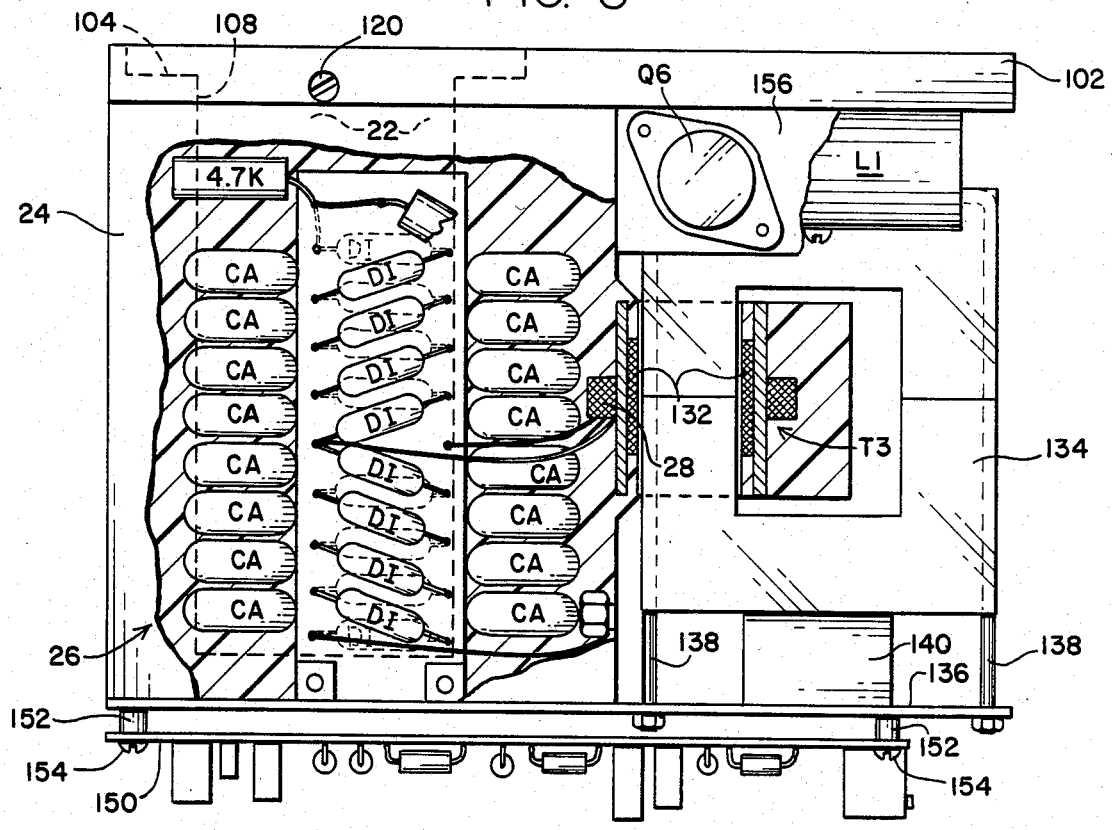
FIG. 6 is a somewhat diagrammatic view in side elevation and partial section of the system depicted in FIG. 1 with certain portions of the structure thereof broken away in aid of clarity of illustration.
Figure 9:
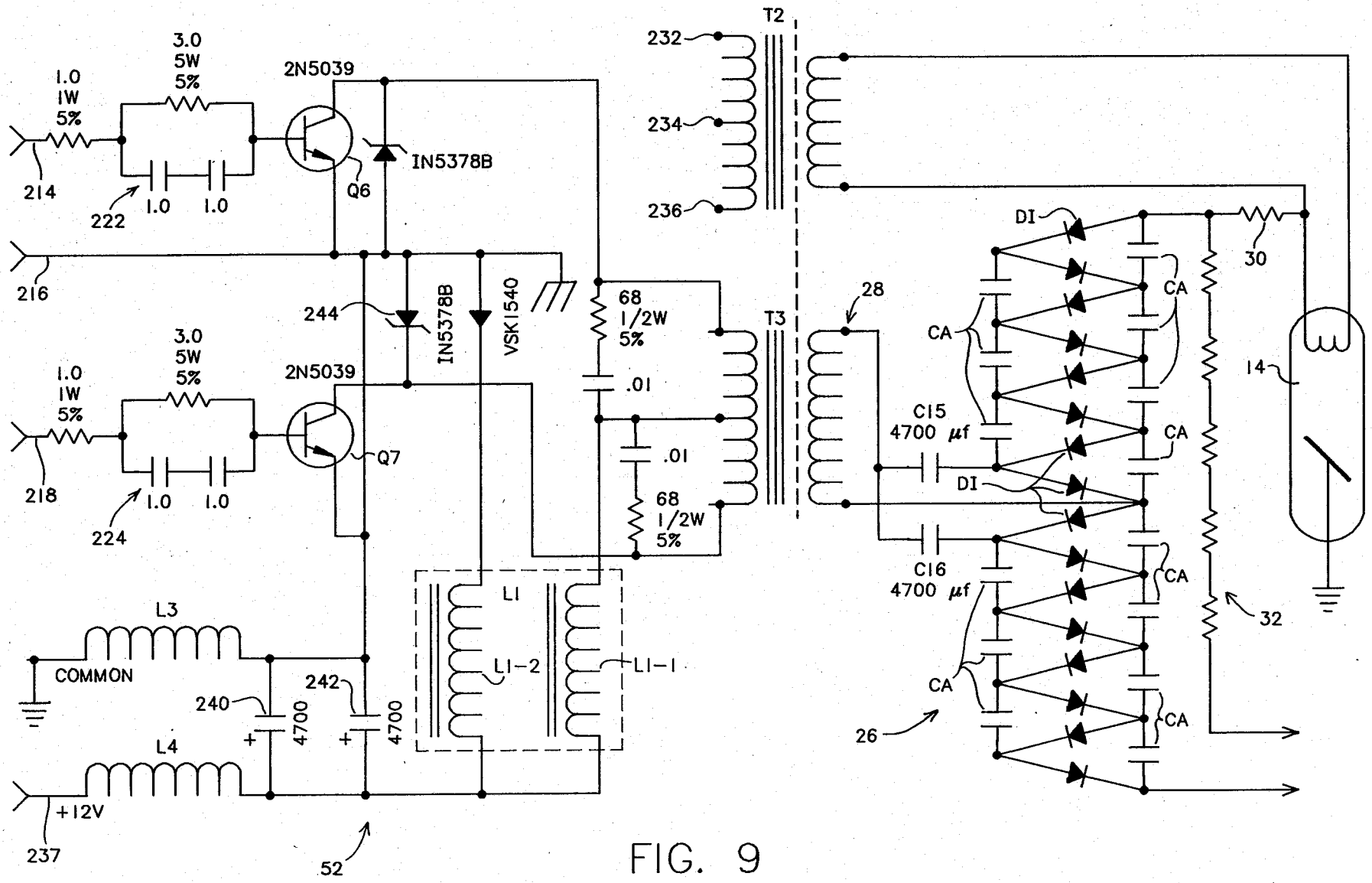
FIG. 9 is a schematic circuit diagram of high power and voltage circuitry for the system depicted in FIGS. 1 and 2.

Turning now to FIG. 6, the vacuum formed block 24 has been broken away to reveal the embedded Cockcroft-Walton voltage multiplier array 26. The array 26 is comprised of diodes DI and capacitors CA mounted physically as shown in FIG. 6 and connected electrically as shown in FIG. 9. The physical placement of the embedded high voltage secondary 28, and its corresponding primary winding 132 forming the transformer T3 is also depicted in FIG. 6. Therein, a double opposed-U-shaped transformer core 134 of suitable ferrite material is seated in a well 135 of the block 24. The core 134 is secured to a base plate 136 by a small, elongated U-bolt 138 which extends about the periphery of the core 134 in a peripheral channel formed therein. The core 134 rests upon and is stabilized in proper position by a spacer 140 interposed between the lower leg of the core 134 and the plate 136. There are two transformers T2 and T3 and the core for the filament transformer T2 is identical to the core 134 for the transformer T3 in structure and mounting, and will not be further described.

Figure 8:
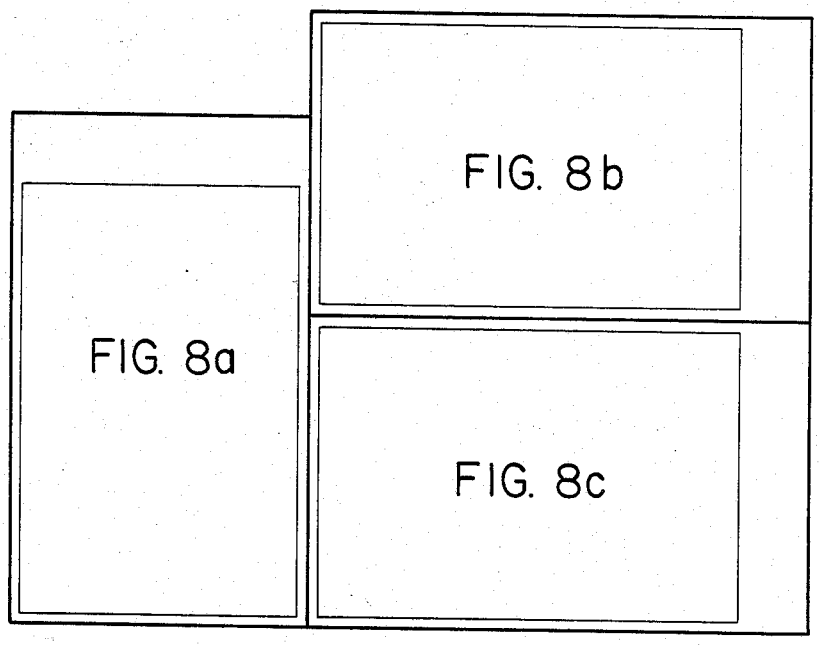
FIGS. 8 (*a–c*) is a schematic circuit diagram of the low power level control circuitry for the system depicted in FIGS. 1 and 2.
Figure 8A:
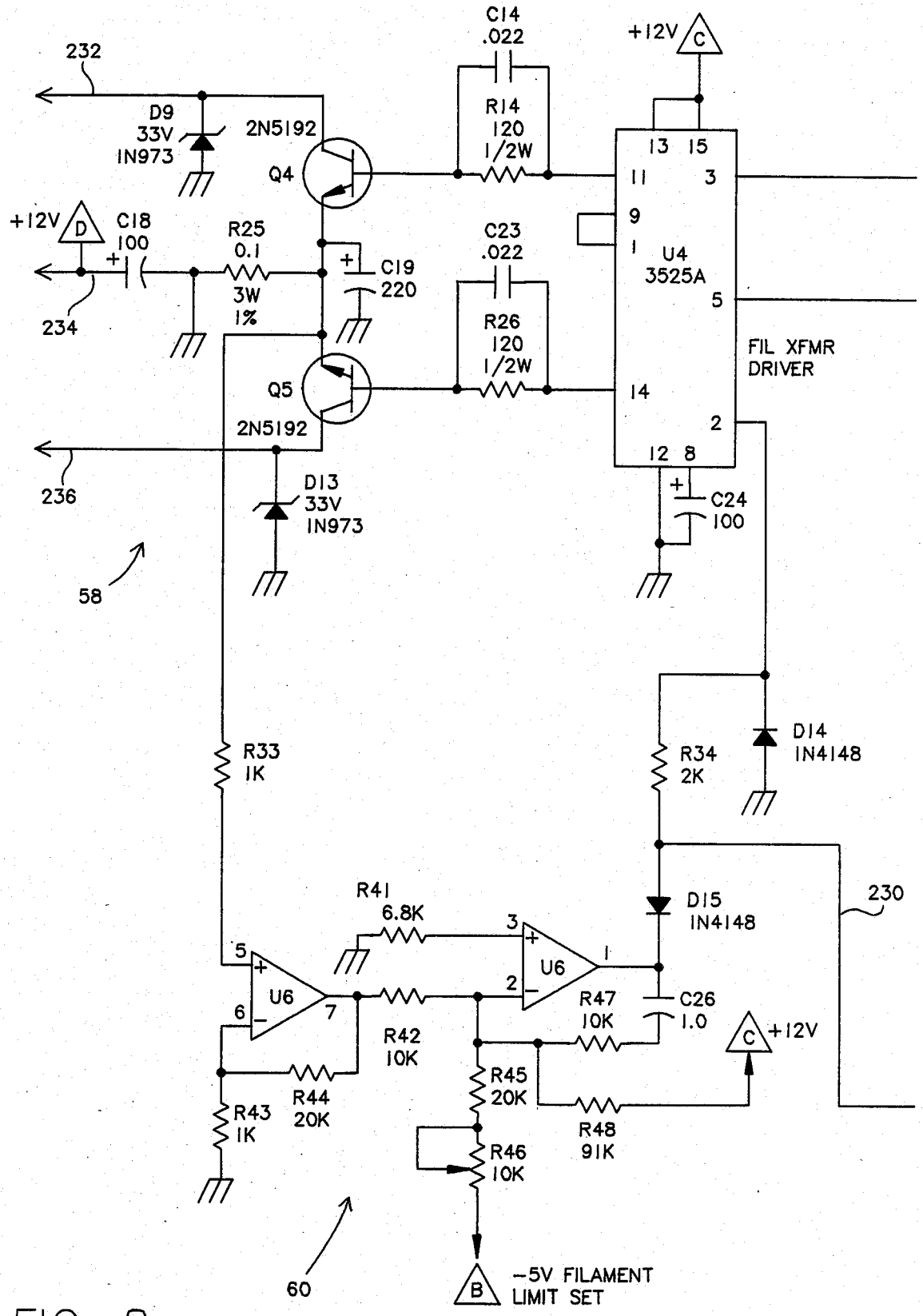
Figure 8B:
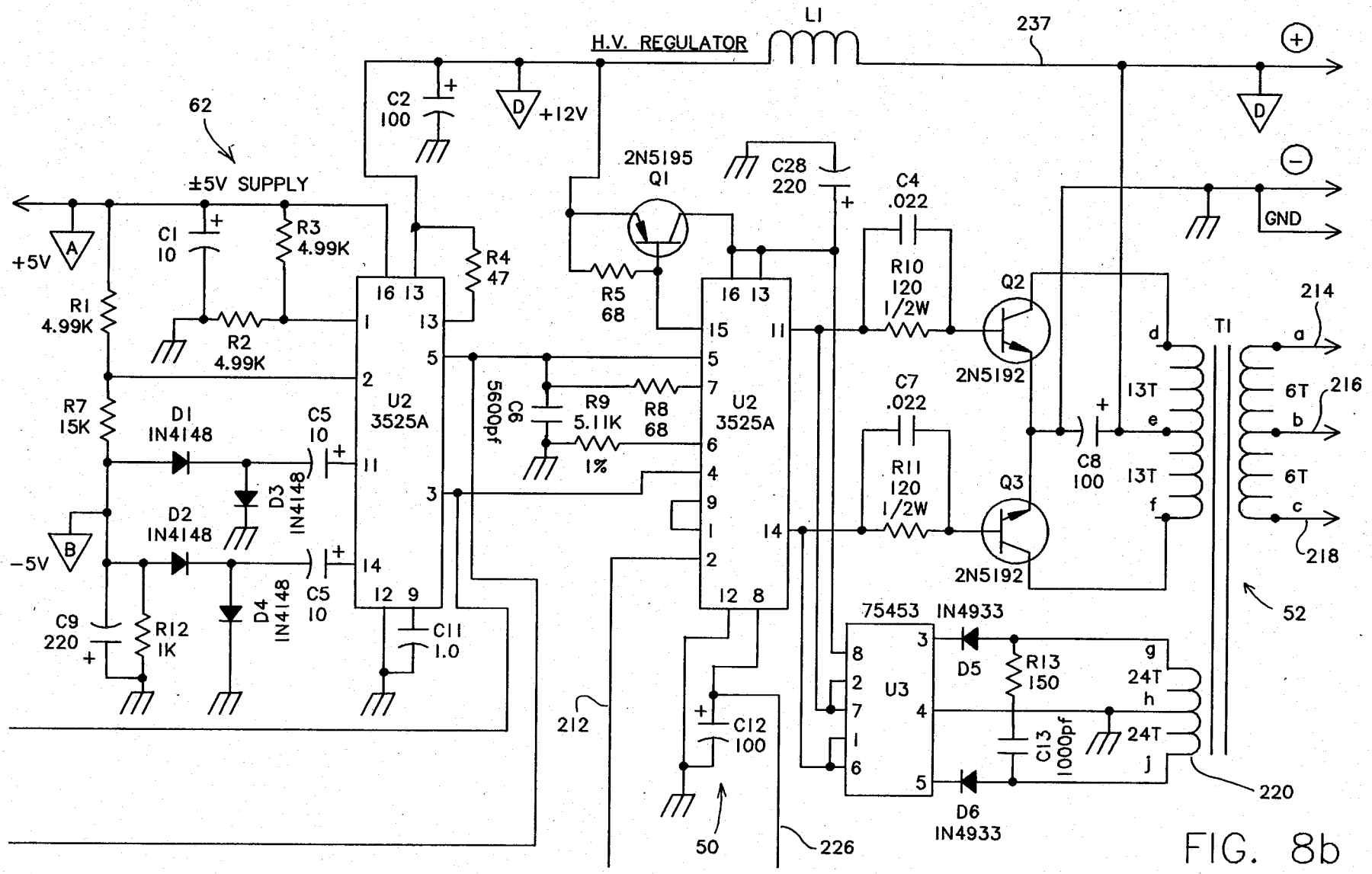
Figure 8C:
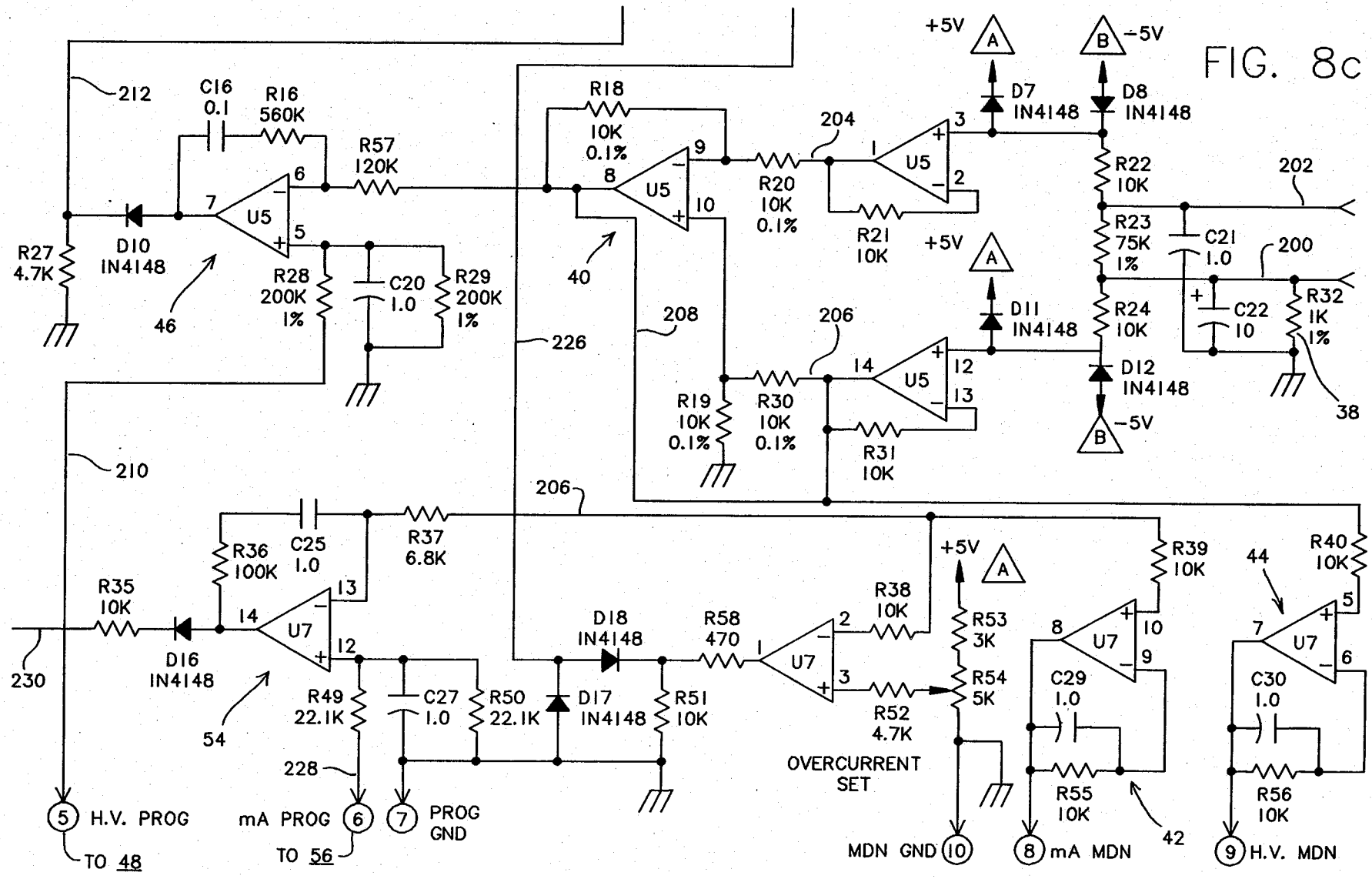

A small, rectangular printed circuit board 150 mounting the components shown in electrical connection in FIG. 8 is mounted to the base plate 136 by spacers 152 and screws 154. Other components including a toroidal wound switching inductor L1 and power switching transistors Q6 and Q7 are mounted either directly to the thick top plate 102 or thereto by suitable bracketing 156.

Block 24

Figure 7:
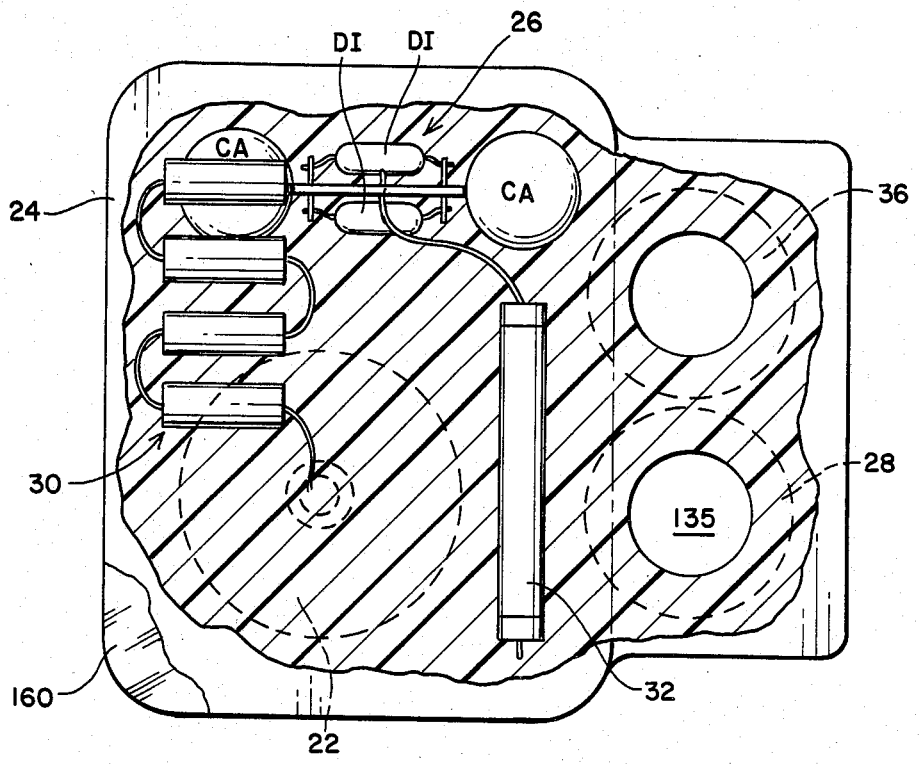
FIG. 7 is a bottom plan view of the cast high voltage transformer and tube housing block of the system depicted in FIG. 1.

Further details of the vacuum formed epoxy block 24 may be found in the diagrammatic bottom view thereof in FIG. 7. The side-by-side embedded secondaries 28 and 36 of the transformers T3 and T2, respectively are shown in their preferred physical layout. Also the placement of the voltage multiplier array 26 in relation to the well 22 for the x-ray tube is shown in FIG. 7. The vacuum formed plastic block 24 easily yields the required 50 kV insulation required for operation of the system 10, providing there are no voids or entrained air pockets therein which lead to corona and breakdown modalities. The block 24 is provided with a conductive coating 160 (only a small segment of which is shown in FIG. 7) in order to minimize the buildup of static electricity.

FIG. 8 Circuitry

The high voltage and beam current monitor circuit 40, as well as other amplifier circuitry depicted in FIG. 8, is preferably implemented with an array of interconnected operational amplifiers, such as the type LM 324A quad operational amplifier available from a number of semiconductor manufacturers.

The voltage proportional to beam current developed across the resistor 38 enters the circuit board 150 via a line 200, and voltage proportional to the high voltage as measured by the 1500 megohm resistor chain 32 enters the circuit board 150 via a line 202. These two signals are differentially amplified by two operational amplifiers U5-1 and U5-4. The first amplifier U5-1 is connected to a third operational amplifier U5-3 via a line 204, and the second amplifier U5-4 is connected to the amplifier U5-3 by a line 206. The amplifier U5-3 subtracts the voltage proportional to beam current, put out by the amplifier U5-4 from the voltage proportional to the high voltage put out by the amplifier U5-1 to yield a voltage truly proportional to the high voltage applied to the x-ray tube 14. This high voltage measurement signal is put out on a line 208 and extends to an operational amplifier buffer U7-2 in the voltage monitor circuit 44.

The signal via the line 208 also enters another operational amplifier U5-2 which forms the high voltage control preamplifier circuit 46. A programmable reference voltage is also supplied to the amplifier U5-2 via a line 210 from the remote voltage control circuit 48. The amplifier U5-2 calculates the difference between measured voltage on the line 208 and commanded voltage on the line 210, and puts that difference voltage out on a line 212.

The difference voltage on the line 212 which represents a control signal is applied to a control mode of a monolithic pulse width modulator (PWM) circuit U2, which preferably is of the type 3525A made by Silicon General. The output of the PWM U2 is a pair of pulse trains at pins 11 and 14 which have duty cycles proportional to the control voltage on the line 212 and which are 180 degrees phase shifted with each other. These pulse trains are applied to a push-pull amplifier formed of transistors Q2 and Q3 and the transformer T1. The secondary winding of the transformer T1 is connected to drive power amplifier transistors Q6 and Q7 (FIG. 9) by lines 214, 216 and 218.

The transformer T1 is provided with a tertiary winding 220 which is connected to a logic array U3. The logic array U3 senses the variable dead time periods between the duty cycles of the pulses put out by the PWM U2 and shunts the tertiary winding to very low impedance during this dead time. In this manner, switching capacitors 222 and 224 (FIG. 9) in the base circuits of the output power transistor switches Q6 and Q7 are rapidly discharged during dead time by the low impedance to ground presented by the secondary winding of T1 when the tertiary winding 220 is essentially shorted by the array U3. Rapid discharge of the capacitors 222 and 224 is required for proper operation of the high voltage switching power supply 52 in order to develop the requisite power output (and consequent high voltage). A driver transistor Q1 is connected to the PWM U2 and to the logic array U3 as shown in FIG. 8.

The PWM U2 is also connected to drive another PWM U1 which forms the plus and minus 5 volt power supply 62 for operating the operational amplifiers with equally offset voltages. A full wave rectifier and filter circuit comprising the diodes D1, D2, D3 and D4, and the capacitors C5, C9 and C10 are included in the minus 5 volt circuit which puts out this minus reference voltage on a line B. The plus five volt reference supply is developed internally by the PWM U1 and is put out on a line A.

A voltage proportional to beam circuit of the x-ray tube 14 is put out on the line 206 by the operational amplifier U5-4. This voltage directly connects to an operational amplifier U7-3 in the current monitor circuit 42. It also connects to an overcurrent set circuit comprising an operational amplifier U7-1, the output of which is connected to the high voltage PWM U2 by a line 226. At a predetermined excessive tube current level, the x-ray tube is automatically shut down by disabling the PWM U2 of the high voltage supply. The overcurrent limit is set by a potentiometer R54.

The voltage proportional to measured beam current is also supplied to the current control preamplifier 54 by the line 206. This preamplifier is implemented with an operational amplifier U7-4 which is connected to the remote current control circuit 56 by a line 228. The amplifier U7-4 puts out a voltage which is the difference between monitored current and commanded current on a line 230, and this voltage is used to control the duty cycle of a third pulse width modulator U4 in the current regulator and driver circuit 58. Beam current is controlled by filament voltage, and the circuit 58 is implemented as a switching power supply having a controllable duty cycle. The PWM U4 is connected to drive two switching transistors Q4 and Q5 as shown in FIG. 8. The outputs from the transistors Q4 and Q5 are connected to the centertrapped primary of the filament transformer T2 via lines 232, 234 and 236. The line 234 is actually a direct connection to the positive low voltage power supply (e.g. 12 volts DC ), line D. Since the filament 16 of the x-ray tube 14 is essentially resistive, a flyback inductor is not required, and the current requirements for the filament are low, so an elaborate power driver circuit is not required for the filament supply 58, in comparison to the high voltage supply 52.

If the high voltage is programmed to be very low, the current sense correction voltage put out on the line 230 tends to drive the tube filament current higher and higher. Theoretically, at zero high voltage, the filament would be told to pass infinite current. Of course, this tendency will burn out the filament, unless a protection circuit is employed. The current limit control circuit 60 is therefore provided. It is implemented with two operational amplifiers U6-1 and U6-2. Maximum filament current is set by a potentiometer R46.

FIG. 9 Circuitry

The power output stage of the high voltage driver circuit 52 is depicted in FIG. 9 as is the Cockcroft-Walton voltage multiplier 26, transformers T2 and T3 and X-ray tube 14. The circuit elements depicted in FIG. 9 are not on the printed circuit board 150 and are otherwise contained in the block 24 or mounted to the housing 12, etc.

The controlled duty cycle pulse trains put out at the secondary of the transformer T1 is coupled to the base circuits of the output transistors Q6 and Q7. The two pulse trains are amplified and presented at the centertapped primary of the transformer T3. The inductance of the secondary 28 of the transformer T3 is conventionally resonated at the switching frequency by the distributed capacitance of the voltage multiplier array 26. The secondary 28 thereof is connected to midpoint nodes of the Cockcroft-Walton multiplier array 26, and thereby floats at a very high voltage (e.g. 25 kV when the array puts out 50 kV). Thus, it is not practical to provide the required flyback inductance on the secondary side of the transformer T3. This inductance, provided by the inductor L1, is connected to the primary side of T3 as shown in FIG. 9.

The inductor L1 is provided with two windings L1-1 and L1-2. Every time the transistor switches Q6 and Q7 are off, the inductor L1 reacts to the loss in current and will put out a very large voltage pulse. This pulse is stored in a current sump formed by two high value capacitors 240 and 242, by passing through a very high speed Schottky diode 244 and the winding L1-2. Inductors L3 and L4 decouple the capacitors 240 and 242 from the primary supply line 237 at the switching frequency of 25 kHz.

The voltage multiplier array 26 is arranged as a pair of back-to-back connected four stage Cockcroft-Walton multipliers. The convenience of this arrangement is compactness. By connecting the stages back-to-back, the ripples subtract, and a smoother high voltage output is achieved.

While the system 10 is illustrated with grounded anode reflective 14 and transmissive 14*a* x-ray tubes, it is readily apparent that a grounded filament tube would be suitable for use in the system 10. In addition, a pulser tube, having a control grid element and known pulse control circuitry is readily adaptable for use in accordance with the principles of the present invention.

While apparatus of the present invention has been summarized and explained by illustrative applications of a modular portable x-ray source with integral generator systems, it will be readily apparent to those skilled in the art that many widely varying embodiments and applications are within the teachings and scope of the present invention, and that the examples presented herein are by way of illustration only and should not be construed as limiting the scope of this invention.

I claim:

1. A modular portable x-ray source with integral generator system for generating continuous x-rays of regulated intensity and energy level, said system comprising:

an x-ray tube having a cathode and a grounded anode emitting x-rays as a consequence of bombardment of an accelerated electron beam emitted by said cathode, a direct current high voltage power supply including a high voltage step-up transformer having coaxially wound primary and secondary windings and a ceramic ferrite core coaxial therewith, and a voltage multiplier of plural cascaded capacitors and diodes for generating a directly controllable continuous, smoothly variable direct current high voltage from a low voltage externally supplied from a low voltage direct current supply, said direct current high voltage being directly connected and applied without external cables across said cathode and anode to generate x-rays of predetermined, substantially constant energy level, unitary housing means including a molded solid block of rigid cured plastic resin material in which substantially all air pockets and other voids have been removed, said block having an electrostatic outer shield coating, said block defining a well in which said x-ray tube is removably mountable and wherein the cathode thereof is connectable to the voltage multiplier of said direct current high voltage power supply and said block encapsulating said primary and secondary windings of said transformer and said voltage multiplier, said ceramic ferrite core being external to said block and passing through an opening defined therethrough which is coaxial with said primary and secondary windings, thereby facilitating differential thermal expansion of said core relative to said block without damage to said core.

2. The system set forth in claim 1 wherein said cathode comprises a thermionic emission direct filament electron gun and further comprising filament power supply means for supplying regulated filament current to operate said filament of said x-ray tube, said filament power supply means including means for presetting beam current by controlling x-ray tube filament current and including a filament transformer having coaxial primary and secondary windings encapsulated in said block and a ceramic ferrite filament core external to said block and passing through an opening in said block coaxial with said primary and secondary windings, thereby facilitating differential thermal expansion of said filament core relative to said block without damage to said core, means for monitoring current through said direct filament electron gun and for limiting monitored filament current to a maximum preset value, thereby preventing filament burnout.

3. The system set forth in claim 1 wherein said low voltage supply is a direct current storage battery.

4. The system set forth in claim 1 wherein said direct current high voltage power supply comprises means for remotely presetting said high voltage and means for monitoring said high voltage directly to maintain it at a said preset value.

5. The system set forth in claim 2 wherein said filament power supply means comprises means for remotely presetting x-ray tube beam current and means for monitoring and controlling said beam current directly to maintain it at a said preset value.

6. The system set forth in claim 1 wherein said direct current high voltage power supply comprises means for monitoring said high voltage directly and for feeding back a voltage control signal for controlling said high voltage to yield a highly stable x-ray energy level substantially independent of variations in said low voltage supply.

7. The system set forth in claim 2 wherein said filament power supply means comprises means for monitoring said beam current directly and for feeding back a current control signal for controlling x-ray tube beam current to yield a highly stable x-ray intensity substantially independent of variations in said low voltage supply.

8. The system set forth in claim 1 wherein said anode is of the solid target emissive type.

9. The system set forth in claim 1 wherein said anode is of the foil transmissive type wherein x-rays emerge essentially on the same axis as of the electron beam.

10. The system set forth in claim 8 wherein said anode comprises a solid target, and said x-ray tube comprises an x-ray window adjacent said solid target and having an axis substantially at right angles to the axis of the electron beam striking said solid target.

11. The system set forth in claim 1 further comprising a finned heat sink conductively connected to said unitary housing means for conducting heat away by air flow.

12. The system set forth in claim 1 further comprising insulating and gas displacing cooling liquid in said well.

13. The system set forth in claim 12 further comprising cooling liquid expansion and contraction buffer means for enabling said cooling liquid to expand and contract in response to thermal changes in said system without escaping from said housing.

14. The system set forth in claim 13 wherein said buffer means comprises a cylinder communicating with said well, and a piston in slidable sealing engagement in said cylinder for moving relatively as said liquid expands and contracts.

15. The system set forth in claim 1 wherein said high voltage power supply includes a plurality of multiple stage voltage multipliers with outputs connected in series so that their output voltages are additive.

16. The system set forth in claim 15 wherein said high voltage power supply includes switching transformer means having a secondary winding connected to said plurality of voltage multipliers at nodes approximately one half of the high voltage put out from said multipliers to said x-ray tube.

17. The system set forth in claim 6 wherein said high voltage power supply is of the switching type having a variable duty cycle and includes a controllable duty cycle pulse width modulator, the duty cycle of which being regulated by said voltage control signal.

18. The system set forth in claim 7 wherein said filament power supply means is of the switching type having a variable duty cycle and includes a controllable duty cycle pulse width modulator, the duty cycle of which being regulated by said current control signal.

19. The system set forth in claim 7 further comprising an overcurrent set circuit responsive to said current control signal and connected to reduce said high voltage supply in the event that x-ray tube current exceeds a predeterminable maximum set point.

20. A modular portable x-ray source with very high stability integral generator for generating continuous x-rays of regulated intensity and energy level, said system comprising:

an x-ray tube having a cathode and a grounded anode emitting x-rays as a consequence of bombardment of an accelerated electron beam emitted by said cathode, a direct current high voltage power supply for generating a continuous, directly controllable, smoothly variable direct current negative high voltage in a range from zero volts to maximum negative high voltage by modulating the pulse width of a switching inverter operating at a substantially constant frequency supplied by an oscillator and driven from a low voltage externally supplied from a low voltage supply, the selected high voltage from said supply being connected and applied across said cathode and grounded anode to generate continuous x-rays of predetermined, substantially constant energy level, said high voltage supply including means for monitoring said high voltage directly at the cathode of said x-ray tube and for generating a voltage control signal for maintaining high voltage at its selected value irrespective of voltage level from said low voltage supply and beam current between said cathode and anode of said x-ray tube, unitary housing means for mounting and enclosing said x-ray tube and said direct current high voltage power supply as a single module.

21. A modular portable x-ray source with integral generator system for generating continuous x-rays of regulated intensity and energy level, said system comprising:

an x-ray tube having a directly heated filament and a grounded anode emitting x-rays as a consequence of bombardment of an accelerated electron beam emitted by said filament, a direct current high voltage power supply for generating a directly controllable, continuous, smoothly variable direct current negative high voltage from a low voltage externally supplied from a low voltage supply, the selected negative high voltage from said supply being connected and applied across said cathode and grounded anode to generate x-rays of predetermined, substantially constant energy level, filament power supply means including a switching filament supply inverter operating at a substantially constant switching frequency for generating regulated filament current to operate said filament of said x-ray tube from a low voltage externally supplied from said low voltage supply, said filament power supply means including means for presetting beam current in a range from zero beam current to maximum beam current by controlling x-ray tube filament current by modulating the pulse width of said switching filament supply inverter, said filament power supply means further including means for monitoring said beam current directly and for feeding back a beam current control signal for maintaining beam current at a said preset value, unitary housing means for mounting and enclosing said x-ray tube, said direct current high voltage power supply and said filament power supply means as a single module, an overcurrent set circuit responsive to said beam current control signal and connected to reduce said high voltage supply in the event that x-ray tube current exceeds a predeterminable maximum set point thereby preventing excessive dissipation and resultant damage of said anode, and means for monitoring filament current and for limiting monitored current to a maximum preset value, thereby preventing filament burnout.

22. The system set forth in claim 20 further comprising high voltage remote control means for remote presetting of high voltage and high voltage remote monitor buffer amplifier means for remote monitoring of high voltage.

23. The system set forth in claim 21 further comprising beam current remote control means for remote presetting of x-ray tube beam current and beam current remote monitor buffer amplifier means for remote monitoring of x-ray tube beam current.

* * * * *